US005713194A

United States Patent [19]

Grässle et al.

[11] Patent Number: 5,713,194

[45] Date of Patent: Feb. 3, 1998

[54] ROVING MACHINE WITH REPLACEABLE FLYERS FOR WINDING ROVING BOBBINS OF DIFFERENT DIAMETERS

[75] Inventors: Herbert Grässle, Schwäbisch-Gmünd Metlangen; Hans-Peter Weeger, Hattenhofen, both of Germany

[73] Assignee: Zinser Textilmaschinen GmbH, Ebersbach/Fils, Germany

[21] Appl. No.: 810,849

[22] Filed: Mar. 4, 1997

[30] Foreign Application Priority Data

Mar. 4, 1996 [DE] Germany ..... 196 08 199.8

[51] Int. Cl.[6] ..... D01H 1/04; D01H 7/24

[52] U.S. Cl. ..... 57/67; 57/1 R; 57/115

[58] Field of Search ..... 57/1 R, 67, 68, 57/71, 115

[56] References Cited

U.S. PATENT DOCUMENTS 5,117,621 6/1992 Reichtinger et al. ..... 57/278

5,375,405 12/1994 Weeger ..... 57/281

5,522,210 6/1996 Mack ..... 57/281

5,657,623 8/1997 Mack et al. ..... 57/67

*Primary Examiner*—William Stryjewski

*Attorney, Agent, or Firm*—Herbert Dubno

[57] ABSTRACT

A roving frame for producing large-diameter and small-diameter roving bobbins has two rows of work stations with the work stations lying at vertices of a triangle for the production of small-diameter bobbins, flyers of a small span are provided for each of the spindles at each of the work stations whereas these flyers are replaced by large-span flyers which are located at every second work station. The triangle base has a length L which is just slightly greater than the diameter of the flyer in the case of the small diameter bobbins whereas the triangle side lengths are substantially equal to the diameter of the large-span bobbins.

6 Claims, 1 Drawing Sheet

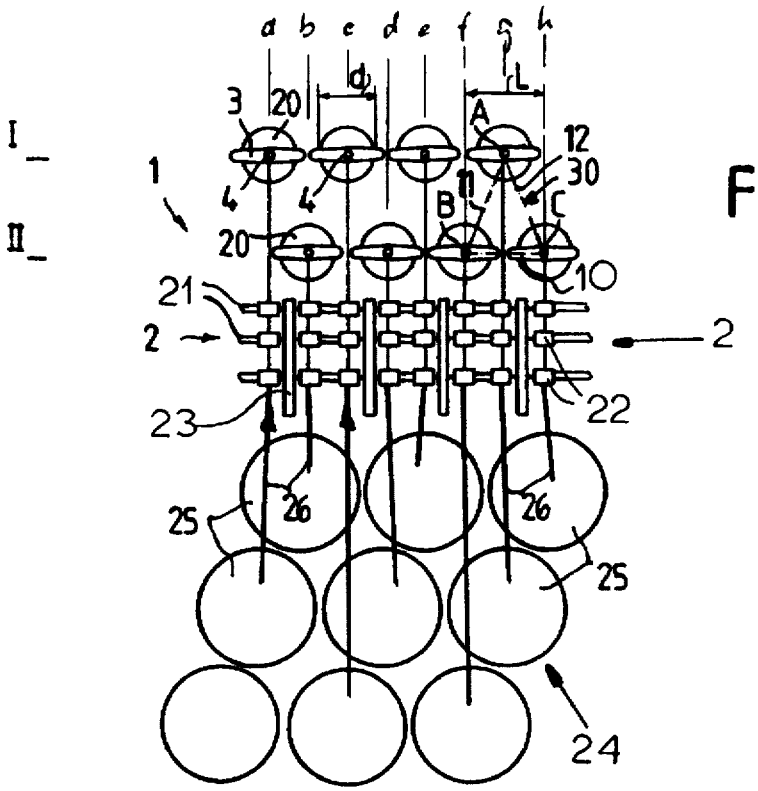
Fig.1
Fig.2
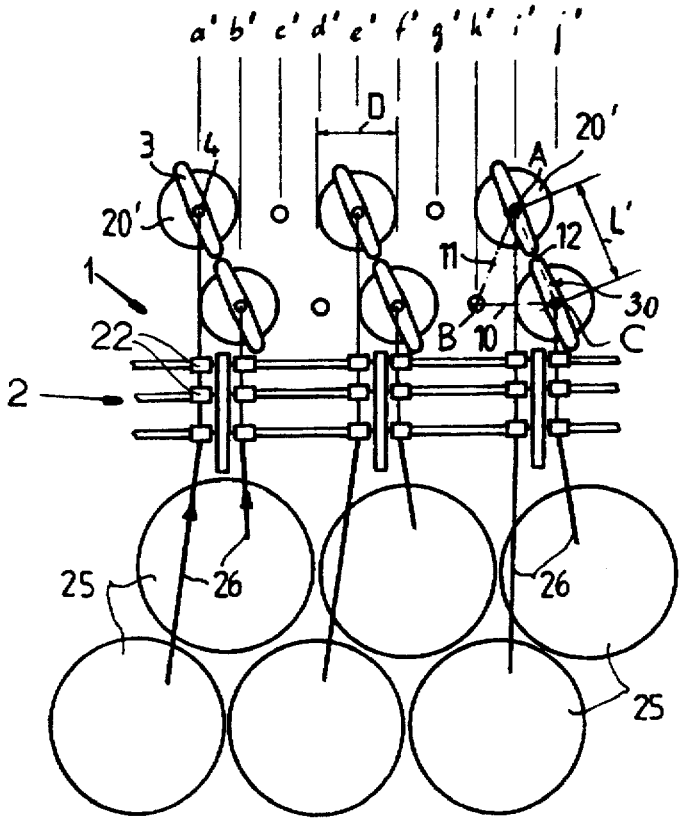

ROVING MACHINE WITH REPLACEABLE FLYERS FOR WINDING ROVING BOBBINS OF DIFFERENT DIAMETERS

FIELD OF THE INVENTION

Our present invention relates to a roving frame having a multiplicity of work stations and bobbin spindles provided in two mutually offset rows whereby the flyers and bobbin spindles of each work station are disposed at the vertex of a triangle whose base extends in the longitudinal direction of the roving frame. The base length thus defines the interaxial work station spacing of each row of roving frames, i.e. the so-called pitch of the work stations. The invention, in particular, relates to machines of this type which can wind sliver into roving bobbins of different diameters and to a method of operating a roving frame so as to selectively wind bobbins of different diameters.

BACKGROUND OF THE INVENTION

Roving frames with mutually offset rows of work stations, whereby two successive work stations along each row define a base of a triangle whose vertex opposite the base is a work station of the other row located between the two work stations at the base vertices, have been provided heretofore. It is customary in such machines to provide the axes of the flyers and spindles at the vertices of an approximately equilateral triangle. The lengths of the sides of this triangle are not substantially greater than the diameter of the cylinders of rotation described by the flyer arms, i.e. the span of the flyer which is provided for producing flyer bobbins of a certain maximum diameter. When it is desired to modify this machine to wind bobbins of greater diameter, the flyers are replaced with flyers of greater span and hence greater diameters of the respective cylinder of rotation and then at least every second work station in each row must be omitted to allow the flyers to swing without interfering with one another. In practice this has meant that in every work station of the machine no more than four can be operated with the flyers of larger span or diameter.

Since a greater machine depth with somewhat greater spacing of the two rows of flyers and spindles from one another can be accommodated in many cases, it has been possible to provide the vertices of the triangle at which the axes of the flyers and spindles are located so that isosceles triangles are formed with the base being the shortest side and the sides connecting the base to the vertex or axis of the flyer and spindle of the other row being slightly longer. Even in this case, however, the number of work stations which are available when larger diameter bobbins are to be wound is usually less than one-half the maximum number of work stations.

To avoid this reduction in the number of available work stations for the winding of larger diameter roving bobbins, the pitch of the work stations in the longitudinal direction of the roving frame may be so increased that this pitch allows for the production of bobbins of larger diameter. This has the drawback of increasing the overall length of the machine for a given number of work stations per row and may be uneconomical for the production of bobbins of smaller diameters.

OBJECTS OF THE INVENTION

It is, therefore, the principal object of the present invention to provide a roving frame in which the total number of available work stations can be increased, even upon switchover to the winding of larger diameter bobbins by comparison to earlier systems without requiring an increase in the pitch, i.e. the base length for the distance between two work stations along each row.

It is another object of the invention to provide an improved roving frame whereby the drawbacks of earlier systems can be obviated.

It is also an object of this invention to maximize the number of work stations of a roving frame both for production of bobbins of the smallest diameter which can be wound on the machine as well as for the winding of the largest diameter bobbins.

Yet another object of this invention is to provide an improved method of operating a roving frame whereby drawbacks of earlier systems are obviated.

SUMMARY OF THE INVENTION

These objects and others which will become apparent hereinafter are attained, in accordance with the invention by providing the lengths of the bases at least as large as the required spacing of the flyer axes for the production of bobbins of a lesser diameter but not substantially greater than this spacing while providing the lengths of the sides of the triangle at least as large as the requisite distance of the flyers in the production of bobbins of a greater diameter but not substantially greater. Flyers are provided only at each second work station to cooperate with the respective spindle in forming the larger diameter bobbin.

Of course, where the spindles themselves must be removed when the alternate flyers are removed, their respective spindles are removed as well. Usually, however, the spindles can be left in place since the spindles can operate with bobbins of any diameter, including smallest and largest diameters.

One of the advantages of the invention is that the drive energy is conserved, the vortexing and turbulence of the air in the region of the flyers which remain operative is reduced, accessability is improved and the danger of breakdown is reduced.

The triangles at the vertices of which the flyers are rotatable about their respective upright axes can be scalene triangles. An advantageously uniform feed of the sliver with both full and partial equipping of the flyer frame with flyers and bobbins can be achieved, however, when these triangles are isosceles triangles.

The invention permits a substantially variable number of work stations to be accommodated along each row with a larger number of bobbins being wound for a wide range of bobbin diameters between the smallest bobbin diameter and the largest bobbin diameter of the range. In the production of bobbins of larger diameter than that for which the original spacing of the flyer axes within a row is designed, two neighboring flyer/ spindle stations of the two rows are left operative while the next two may remain inoperative, alternately down the rows. The upper rollers of the drafting frame may be paired as well on a common loading arm so that the two sets of upper rollers of each arm feed the pair of flyer/spindle assemblies of the two rows which are operative. The loading arms and upper rollers of the pair of work stations which are inactive can be left in place and simply not threaded with the sliver, or can be removed as will be described in greater detail.

An elongated roving frame for receiving sliver and flyer winding roving bobbins of at least two diameters including a smallest diameter and a largest diameter can comprise:

two rows of spaced apart work stations running in a longitudinal direction of the spinning frame and having respective spindle axes at which roving bobbins can be wound, the axes of one of the rows being offset from the axes of another of the rows so that each two successive axes of one row and an axis of the other row located between the two successive axes define vertices of a triangle having a base along the one row and sides running from the two successive axes of the one row to the axis of the other row between the two successive of the one row;

respective spindles adapted to be provided at each of the axes for winding a respective bobbin of at least the smallest diameter at each of the work stations;

respective sets of flyers for each diameter of bobbins to be wound on the roving frame and having respective spans to accommodate the respective wound bobbins therein, the sets of flyers including a set of smallest-span flyers for mounting at each of the work stations for rotation about the respective axes thereof upon winding of the smallest diameter bobbins, and a set of largest-span flyers for replacement of the set of smallest-span bobbins for mounting at each second work station of each of the rows for rotation about the respective axes thereof upon winding of the largest diameter bobbins, the bases having lengths at least equal to a first requisite spacing of axes of the flyers for winding of the smallest diameter bobbins, but not substantially greater than the first requisite spacing, the sides having lengths at least equal to a second requisite spacing of axes of the flyers for winding of the largest diameter bobbins, but not substantially greater than the second requisite spacing.

The method of the invention can comprise the steps of:

(a) forming the roving frame with two rows of spaced apart work stations running in a longitudinal direction of the spinning frame and having respective spindle axes at which roving bobbins can be wound, the axes of one of the rows being offset from the axes of another of the rows so that each two successive axes of one row and an axis of the other row located between the two successive axes define vertices of a triangle having a base along the one row and sides running from the two successive axes of the one row to the axis of the other row between the two successive of the one row, and respective spindles adapted to be provided at each of the axes for winding a respective bobbin of at least the smallest diameter at each of the work stations;

(b) mounting a set of smallest-span flyers having spans to accommodate the smallest wound bobbins therein at each of the work stations for rotation about the respective axes thereof for winding of the smallest diameter bobbins; and (c) replacing the set of smallest-span flyers by and mounting a set of largest-span flyers at each second work station of each of the rows for rotation about the respective axes thereof upon winding of the largest diameter bobbins, the bases having lengths at least equal to a first requisite spacing of axes of the flyers for winding of the smallest diameter bobbins, but not substantially greater than the first requisite spacing, the sides having lengths at least equal to a second requisite spacing of axes of the flyers for winding of the largest diameter bobbins, but not substantially greater than the second requisite spacing.

BRIEF DESCRIPTION OF THE DRAWING

The above and other objects, features, and advantages will become more readily apparent from the following description, reference being made to the accompanying drawing in which:

FIG. 1 is a plan view of some of the work stations of a roving frame showing the production of small diameter roving bobbins thereon; and FIG. 2 is a view of the same roving frame but modified to wind large diameter roving bobbins.

SPECIFIC DESCRIPTION

FIGS. 1 and 2 show the same roving machine 1 which has a multiplicity of drafting frames generally designated at 2 whose lower rollers are continuous and represented by the rollers 21 while the upper rollers 22 are mounted on the loading arms 23 which cause the upper rollers to press against the sliver 24 fed from the cans 25 of a can field 24 against the lower rollers 21 to draw the sliver as it is fed to the flyers and bobbins.

As can be seen also in FIG. 1, for each of the work stations of the roving frame 1, a plurality of the rollers 2 are provided on one side of the arm 23, the upper rollers of the other side of this arm 23 feeding the drafted sliver to an adjoining work station of the other row.

The roving frame 1 itself is comprised of a multiplicity of flyers 3 and respective bobbin spindles 4, each flyer 3 being aligned with the axis of the respective spindle 4. In the embodiment shown in FIG. 1, the axes and spindles lie perpendicular to the plane of the paper and in practice will be substantially upright. Each flyer 3 and a respective spindle 4 has a common axis to form a respective work station, and the work stations and thus the flyers and spindles are disposed in two mutually offset rows I and II. The work stations are represented at a, b, c, d, e, etc. in FIG. 1 and at a', b', c', d' and e' etc. in FIG. 2.

A will be apparent from FIG. 1 as well, each flyer 3 and the respective spindle 4 has its axis at a corner or vortex A, B, C of an isosceles triangle 30 whose base 10 extends in the longitudinal direction of the roving machine 1.

As is also apparent from FIG. 1, the vertices A, B and C of the triangle are so selected that the length L of base 10 is at least as great as the requisite spacing or pitch of the flyers 3 in the rows I and II for the production of bobbins 20 of a smallest diameter d.

From FIG. 2, however, it will be apparent that the length L' of a side 11 of the isosceles triangle is at least so great as the requisite spacing of the flyers 3 between the rows I, II for production of bobbins 20' of a largest diameter D. However, in the case of FIG. 1 it will be also apparent that the distance L is not substantially greater than the distance d whereas from FIG. 2 it is apparent that the distance L' is not substantially greater than the diameter D. The diameters d and D represent the span of the flyers in the case of the smallest diameter and the largest diameter roving bobbins to be fabricated as well.

When the smaller span flyers are replaced by larger span flyers located only at every second work station, the machine can be used to produce the larger diameter bobbins 20'. Thus the machine shown in FIGS. 1 and 2 can be used to fabricate roving bobbins of two different diameters.

In the production of bobbins 20 of a larger diameter D, all of the work stations are present but only each second work station, namely, a', b', e', f', i', j', etc. of each row I or II is equipped with a corresponding flyer 3 and receives a spindle for producing the bobbins 20' of the larger diameter.

Of course, the flyers must then be removably mounted in the machine and to convert the machine from the production of small diameter bobbins to large diameter bobbins, all of the smaller span flyers are removed and every second work station equipped with a larger span flyer. The spindles usually are of the same diameter regardless of the bobbin diameter and need not be replaced although they will not be provided with a sleeve on which a bobbin is to be wound if no bobbin is to be formed at the particular station.

As is also apparent from FIG. 2, the pairs of upper rollers and loading arms of the drafting frame for the unused work stations c', d', g', h', etc. can be removed as well.

We claim:

1. An elongated roving frame for receiving sliver and flyer-winding roving bobbins of at least two diameters including a smallest diameter and a largest diameter, said roving frame comprising:

two rows of spaced apart work stations running in a longitudinal direction of the spinning frame and having respective spindle axes at which roving bobbins can be wound, the axes of one of said rows being offset from the axes of another of said rows so that each two successive axes of one row and and an axis of the other row located between the two successive axes define vertices of a triangle having a base along said one row and sides running from the two successive axes of the one row to the axis of the other row between the two successive of the one row;

respective spindles adapted to be provided at each of said axes for winding a respective bobbin of at least said smallest diameter at each of said work stations;

respective sets of flyers for each diameter of bobbins to be wound on said roving frame and having respective spans to accommodate the respective wound bobbins therein, the sets of flyers including a set of smallest-span flyers for mounting at each of said work stations for rotation about the respective axes thereof upon winding of said smallest diameter bobbins and a set of largest-span flyers for replacement of said set of smallest-span bobbins for mounting at each second work station of each of said rows for rotation about the respective axes thereof upon winding of said largest diameter bobbins, the bases having lengths at least equal to a first requisite spacing of axes of the flyers for winding of said smallest diameter bobbins, but not substantially greater than said first requisite spacing, said sides having lengths at least equal to a second requisite spacing of axes of the flyers for winding of said largest diameter bobbins, but not substantially greater than said second requisite spacing.

2. The roving frame defined in claim 1 wherein said triangles are isosceles triangles.

3. The roving frame defined in claim 1, further comprising sliver drafting rollers feeding sliver to said work stations.

4. The roving frame defined in claim 3 wherein, for winding said largest diameter bobbins, upper drafting rollers feeding a work station of one row and upper drafting rollers feeding an adjacent work station of the other row are mounted on a common loading arm.

5. The roving frame defined in claim 3 wherein, for winding said largest diameter bobbins, drafting rollers of work stations without flyers are removable from said frame.

6. A method of operating an elongated roving frame for receiving sliver and flyer-winding roving bobbins of at least two diameters including a smallest diameter and a largest diameter, said method comprising the steps of:

(a) forming said roving frame with two rows of spaced apart work stations running in a longitudinal direction of the spinning frame and having respective spindle axes at which roving bobbins can be wound, the axes of one of said rows being offset from the axes of another of said rows so that each two successive axes of one row and an axis of the other row located between the two successive axes define vertices of a triangle having a base along said one row and sides running from the two successive axes of the one row to the axis of the other row between the two successive of the one row, and respective spindles adapted to be provided at each of said axes for winding a respective bobbin of at least said smallest diameter at each of said work stations;

(b) mounting a set of smallest-span flyers having spans to accommodate the smallest wound bobbins therein at each of said work stations for rotation about the respective axes thereof for winding of said smallest diameter bobbins; and (c) replacing said set of smallest-span flyers by and mounting a set of largest-span flyers at each second work station of each of said rows for rotation about the respective axes thereof upon winding of said largest diameter bobbins, the bases having lengths at least equal to a first requisite spacing of axes of the flyers for winding of said smallest diameter bobbins, but not substantially greater than said first requisite spacing, said sides having lengths at least equal to a second requisite spacing of axes of the flyers for winding of said largest diameter bobbins, but not substantially greater than said second requisite spacing.

* * * * *